United States Patent [19]

Schmidt

[11] 4,397,360

[45] Aug. 9, 1983

[54] METHOD FOR FORMING DRAIN HOLES FROM A CASED WELL

[75] Inventor: Jerry W. Schmidt, Hobbs, N. Mex.

[73] Assignee: Atlantic Richfield Company, Los Angeles, Calif.

[21] Appl. No.: 280,725

[22] Filed: Jul. 6, 1981

[51] Int. Cl.[3] ..... E21B 7/06

[52] U.S. Cl. ..... 175/61; 175/81; 175/80

[58] Field of Search ..... 175/61, 79, 80, 81, 175/399; 166/298

[56] References Cited

U.S. PATENT DOCUMENTS

| | | | |
|---|---|---|---|
| 2,105,722 | 1/1938 | Barrett et al. | 175/81 |
| 2,207,920 | 7/1940 | Hughes | 175/81 |
| 2,882,015 | 4/1959 | Beck | 175/80 |
| 3,349,845 | 10/1967 | Holbert et al. | 175/81 |
| 3,398,804 | 8/1968 | Holbert | 175/81 |
| 4,266,621 | 5/1981 | Brock | 175/399 |

FOREIGN PATENT DOCUMENTS

| | | | |
|---|---|---|---|
| 262040 | 1/1970 | U.S.S.R. | 175/79 |

OTHER PUBLICATIONS

Drain-Hole Drilling publication, by D. H. Stomnot, 8/17/53.

ARCO Drills Horizontal Drainhole for Better Reservoir Placement, by W. D. Moore III, 9/15/80.

*Primary Examiner*—William F. Pate, III

*Assistant Examiner*—William P. Neuder

*Attorney, Agent, or Firm*—Drude Faulconer

[57] ABSTRACT

A method and apparatus for forming substantially horizontal drain holes into a subterranean formation from a substantially vertical cased wellbore. A casing anchor is set in the casing adjacent the formation and a whipstock is used to mill a window in the casing. A flexible drill string is then used to drill the horizontal drain hole through the window. In one modification, a deflection tool having a deflection surface which has a radius of curvature of between 11 and 28 feet is used for both the milling and drilling operations. In another modification, the milling operation is carried out with a sidetracking whipstock which is then replaced with the above-described deflection tool to carry out the drilling operation. In still another modification, a whipstock adaptor is positioned onto a sidetracking whipstock after the milling operation to convert the sidetracking whipstock into a deflecting tool having the desired radius of curvature for carrying out the drilling operation.

3 Claims, 5 Drawing Figures

METHOD FOR FORMING DRAIN HOLES FROM A CASED WELL

BACKGROUND OF THE INVENTION

The present invention relates to the forming of drain holes from a cased well and more particularly relates to the drilling of substantially horizontal drain holes into a subterranean formation from a previously completed, substantially vertical cased wellbore to thereby effectively extend the production life of said formation.

The use of drain holes to increase the production from hydrocarbon bearing formations has long been known. These drain holes are formed by drilling curved boreholes into the producing formation from at or near the bottom of a main, vertical wellbore before the well is cased and initially completed. In one known technique, a deflecting tool, e.g. special whipstock, is supported on an anchor which digs into the bottom of the main bore. A specially designed, flexible drill string is then lowered into engagement with the deflecting tool to drill a drain hole substantially horizontal from the main bore. For a more complete description of this technique, see U.S. Pat. Nos. 3,349,845 and 3,398,804. In the technique described above, the drain holes are drilled from an open, uncased borehole.

With the advent of recent, worldwide shortages of hydrocarbons, the need to extend the production life of older wells is now more important than ever. One way to increase the production life of several of these older wells is to drill drain holes into a producing formation to increase the effective permeability of the formation therby improving the communication between distant points in the formation and the main wellbore through which the hydrocarbons can flow. However, normally these older wells, when originally completed, are cased with heavy walled, steel casing which is cemented in place throughout the length of the main borehole which, as far as known, has heretofore interferred with the drilling of substantially horizontal drain holes from the main wellbore.

SUMMARY OF THE INVENTION

The present invention provides a method for forming substantially horizontal drain holes from a cased wellbore. Basically, a window is milled in the casing at a point adjacent the formation into which a drainhole is to be drilled. A deflecting tool is then set in the casing and a flexible, drill string is used to drill the drain hole through the milled window.

More specifically, in a first embodiment a casing anchor is set in the casing at the desired depth for drilling a drain hole, i.e. substantially adjacent the formation. A deflection tool, e.g. a special whipstock, is lowered onto the anchor and is supported thereby. The deflecting surface of the deflection tool is formed having a radius of curvature (preferably between approximately 11 feet and approximately 28 feet) necessary to deflect the flexible drill string used in drilling the drain hole from a substantially vertical orientation to a horizontal orientation in a relatively short vertical distance. Casing milling means is first attached to the lower end of the flexible drill string and are lowered on the drill string to engage the deflection tool. The milling means is deflected by the deflecting surface into engagement with the casing and upon rotation of drill string will mill a window in the casing. The drill string is then withdrawn and the milling means is replaced with an earth drilling means for drilling the horizontal drain hole through the milled window.

In a second embodiment, a casing anchor is set in the casing similarly as in the first embodiment. A commercially available, sidetracking whipstock, (i.e. a whipstock having a relatively gradual slope used for milling casing to permit sidetrack drilling from blocked or damaged cased holes) is lowered onto the anchor and is supported thereby. A standard drill string having casing milling means thereon is lowered into engagement with the whipstock and a window is milled in the casing in accordance with known procedures. The drill string and the whipstock are then retrieved and the deflection tool of the above described embodiment is lowered onto the anchor. A flexible drill string having an earth boring means thereon is then lowered into engagement with the deflection tool and a substantially horizontal drain hole is drilled through the milled window.

In a third embodiment, a casing anchor is set in the casing and a sidetracking whipstock, as described above, is lowered thereon. A standard drill string having a commercially available starting mill (i.e. a long tapered, pointed mill) is lowered into engagement with the casing and the drill string is rotated to form a hole through the casing at a point substantially above the lower end of the deflecting surface of the sidetracking whipstock. As soon as penetration through the casing is achieved, the drill string is removed and the starting mill is replaced on the drill string with a laterally cutting, window mill which when lowered back into the wellbore will mill a window in the casing upward from the hole formed by the starting mill. When the desired length of the window is achieved, the standard drill is removed and a whipstock adaptor is lowered onto the sidetracking whipstock. The lower surface of the adaptor conforms to the upper deflecting surface of the sidetracking whipstock and the upper face of the adaptor is formed with the necessary radius of curvature to carry out the drilling of the substantially horizontal drain hole. A flexible drill string having earth boring means on the lower end thereof is then lowered to drill the horizontal drain hole through the milled window.

BRIEF DESCRIPTION OF THE DRAWINGS

The actual construction, operation, and the apparent advantages of the present invention will be better understood by referring to the drawings wherein like numerals identify like parts and wherein.

DESCRIPTION OF THE PREFERRED EMBODIMENTS

Figure 1:
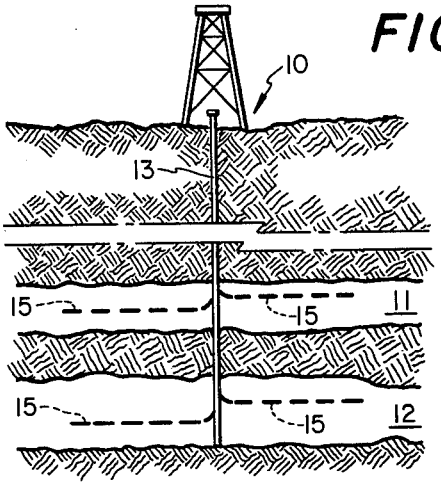
FIG. 1 is a sectional view of a cased well extending through at least one subterranean formation having drain holes completed therein in accordance with the present invention.

Referring more particularly to the drawings, FIG. 1 discloses a well 10 which has been drilled through subterranean, hydrocarbon bearing formations 11, 12. As understood in the art, well 10 has been cased throughout its depth with a relatively thick-walled casing 13. During initial production, casing 13 is perforated adjacent either or both formations 11, 12 and these formations are produced in accordance with well known procedures in art. However, as production declines to near or below economic levels, steps must be taken to prolong the economic life of the producing formations or the well will have to be abandoned leaving unrecovered hydrocarbons in place.

In accordance with the present invention, substantially horizontal drain holes 15 (shown in dotted lines in FIG. 1) are formed from cased wellbore 10 into either or both formations 11, 12. As is known, drain holes of this type effectively increase the drainage area around well 10 and decrease resistance to flow of hydrocarbons from distant points in the formations into well 10 thereby substantially stimulating production from an otherwise declining well.

Figure 2:
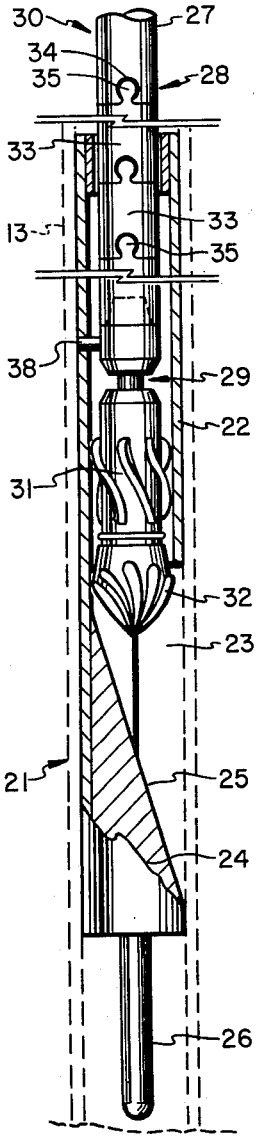
FIG. 2 is an elevational view, partly in section, of apparatus used to carry out milling operations in a first embodiment of the present invention.
Figure 3:
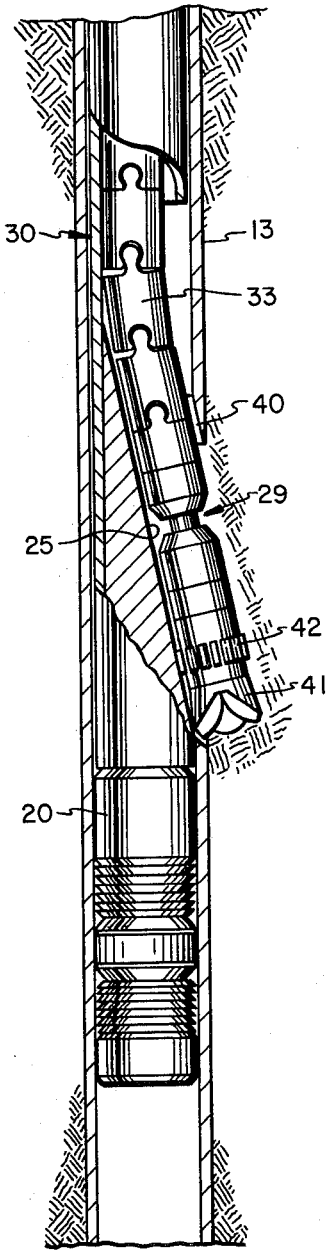
FIG. 3 is an elevational view, partly in section, of apparatus used to carry out drill operations in said first embodiment of the present invention.

One modification for carrying the present invention is illustrated in FIGS. 2 and 3. Casing anchor 20 (FIG. 3) is set in casing 13 substantially adjacent formation 12 and slightly below the point where drain hole 15 (FIG. 1) is to be formed. Casing anchor 20 is preferably a modified wireline-settable, casing packer of the type known as a "whipstock anchor", e.g. a whipstock anchor of the type which is commercially available through Christensen Window Cutting Services, Lafayette, LA.

Deflection tool 21 is adapted to be positioned onto casing anchor 20 and, as illustrated is comprised of a tubular housing 22 which has an elongated slot 23 through one side thereof. Mounted in the lower end of housing 22 is a plug element 24 having deflecting surface 25 thereon which is angularly positioned with respect to the longitudinal axis of tool 21. Deflecting surface 25 lies opposite slot 23 so that drilling can be carried out in a direction which is at an angle with respect to the axis of tool 21. For a drain hole to be drilled substantially horizontal from casing 13 in accordance with the present invention, the radius of curvature (i.e. continuous changing slope) of deflecting surface 25 must be relatively small to provide the desired build angles (2° to 6°/foot) for the drilling operations. In the present invention, this radius of curvature preferably is between approximately 11 feet and approximately 28 feet. For example, a deflecting surface 25 having a radius of curvature of 19 feet will deflect a flexible drill string (to be described below) from a vertical orientation to a horizontal orientation in a vertical distance of approximately 25 to 30 feet.

Stinger pipe 26 is secured to bottom of plug element 25 and is adapted to be received in a cooperating, longitudinally extending opening (not shown) in anhor 20 when said deflecting tool 21 is supported in an operable position on anchor 20 within casing 13.

Flexible drill string 30 shown in FIGS. 2 and 3 comprises drill pipe 27 having a flexible shaft 28 secured thereto. As illustrated knuckle or universal joint 29 connects flexible shaft 28 to a casing milling means, e.g. string mill 31 and tapered mill 32 (FIG. 2). Flexible shaft 28 may be of any suitable construction which will permit the drill string to follow a drill path from vertical to a horizontal direction from casing 13 and at the same time be capable of transmitting torque through the drill string to the milling means. As illustrated, shaft 28 is comprised of a number of tubular sections 33 joined together by means of interconnecting lobes 34 and sockets 35.

As illustrated, flexible drill string 30 is connected to deflecting tool 21 by means of frangible pin 38 so that deflection tool 21 can be lowered into position onto casing anchor 20 by means of flexible drill string 30. The directional orientation of deflecting surface 25 on deflection tool 21 is accomplished by conventional techniques well known in the art.

Operations are commenced by applying downward force on drill pipe 27 to shear pin 38. Rotation of pipe 27 will rotate tapered mill 32 and upon continued downward movement, mill 32 will be deflected by deflecting surface 25 into contact with casing 13 thereby milling a longitudinally extending window 40 (FIG. 3) in casing 12. When the window has been milled, flexible drill string 30 is withdrawn and tapered mill 32 and string mill 31 are replaced with an earth boring means, e.g. drill bit 41 (FIG. 3) and reamer 42. Flexible drill string 30 is again lower and horizontal drain hole 15 (FIG. 1) is drilled as bit 41 is deflected by deflection tool 21 into the desired direction. For a more complete description of this drilling operation and further details as to deflection tool 21 and flexible drill string 30, see U.S. Pat. No. 3,398,804 which is incorporated herein by reference.

In another modification of the present invention (not shown), a window is milled in casing 13 by conventional techniques, e.g. those now commercially available from Christensen Window Cutting Services, Lafayette, LA. A casing anchor as described above is set in the casing and a conventional sidetracking whipstock is positioned thereon. As known in the art, a sidetracking whipstock is one which has a relatively gradual sloping deflecting surface thereon which deflects a drill tool from the axis of the casing at a set angle which allows a hole to be drilled having an axis which is substantially a straight line parallel to the deflecting surface. A regular drill string having casing mill means at the lower end is deflected by the whipstock to mill a window in the casing. In accordance with the present invention, the sidetracking whipstock is retrieved after the window in the casing has been milled and is replaced with horizontally deflecting tool 21 previously described. Drilling operations are then carried out with the flexible drill string 30 as shown in FIG. 3 and fully described above.

Figure 4:
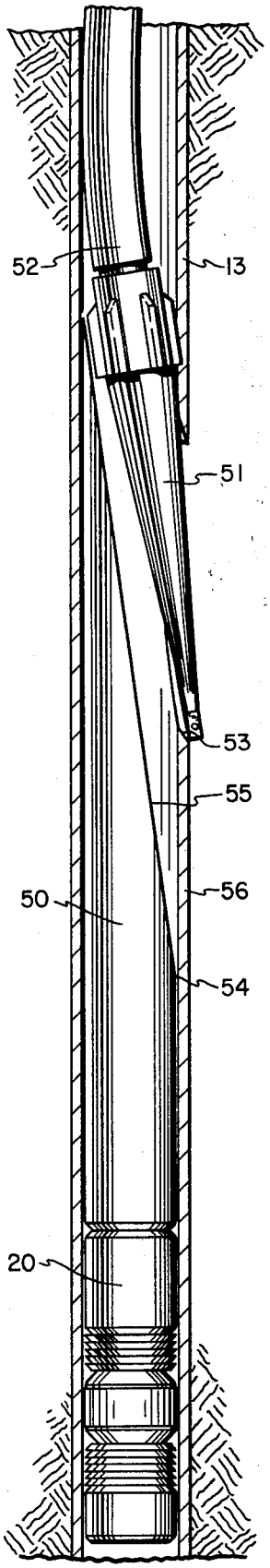
FIG. 4 is an elevational view, partly in section, of apparatus used in another modification of the present invention.
Figure 5:
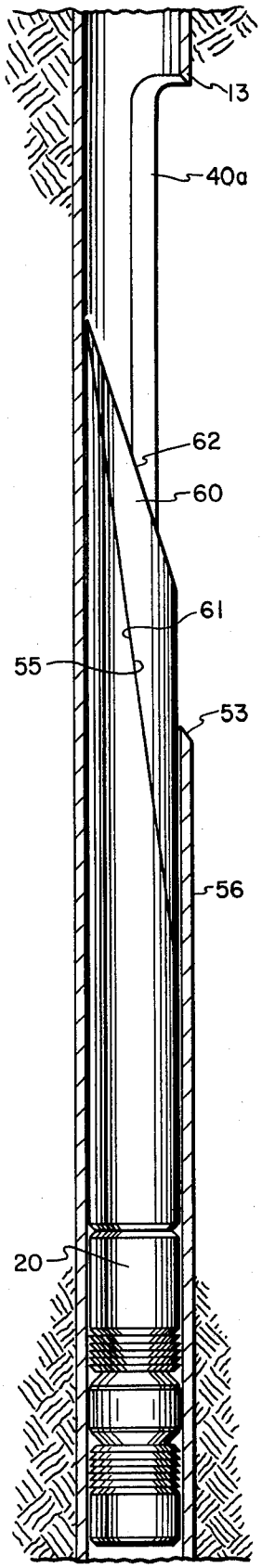
FIG. 5 is an elevational view, partly in section, of a whipstock adaptor of the present invention in an operable position within a wellbore.

Still another modification of the present invention is shown in FIGS. 4 and 5. Casing anchor 20 is set and conventional sidetracking whipstock 50 is lowered onto casing anchor 20. A commercially-available starting mill 51 is lowered on a regular drive string 52 and is deflected by whipstock 50 into contact with casing 13. Milling is continued only until the tip of mill 51 penetrates casing 13 a short distance, thereby forming a hole 53 which is substantially above the lower end 54 of deflecting surface 55. Drill string 52 is then retrieved and a window **40*a* (FIG. 5) is milled upward from hole 53 by known milling techniques, see U.S. Pat. No. 4,266,621. By forming window 40*a* in this manner a lip 56 of casing 13 is provided extending from lower end 54 of whipstock 50 to the lower end 53 of window 40*a***.

Whipstock adaptor 60 is then lowered onto sidetracking whipstock 50. Adaptor 60 is constructed with a lower face 61 having a slope which conforms with the slope of deflecting surface 55 of sidetracking whipstock 50 and an upper deflecting surface 62 having the desired radius of curvature for carrying out the horizontal drilling operations. Adaptor 60 is oriented by the contacting surfaces 61 on adaptor 60 and 55 on sidetracking whipstock 50 and is held in place by its abutting relationship with lip 56 on casing 13. The horizontal drilling of a drain hole 15 through window 40*a* is then carried out with the flexible drill string 30 as shown in FIG. 3 and described above.

What is claimed is:

1. A method for forming a substantially horizontal drain hole in a subterranean formation from a substantially vertical cased wellbore having casing extending at least adjacent said formation, said method comprising:

setting a casing anchor in said casing substantially adjacent said formation;

positioning a sidetracking whipstock onto said casing anchor;

lowering a drill string having a casing mill attached to the lower end thereof whereby said mill is deflected by said whipstock into contact with said casing;

rotating said drill string to mill a window in said casing;

removing said drill string from said wellbore;

removing said sidetracking whipstock from said casing while leaving said casing anchor in place;

lowering a deflecting tool onto said casing anchor, said deflecting tool having a deflecting surface which has a radius of curvature between approximately 11 and approximately 28 feet;

lowering a drill string having a flexible section on the lower end thereof to which an earth boring means is attached whereby said earth boring means is deflected by said deflecting surface of said deflection tool through said milled window; and rotating said drill string to drill said substantially horizontal drain hole into said formation through said window.

2. A method for forming a substantially horizontal drain hole in a subterranean formation from a substantially vertical cased wellbore having casing extending at least adjacent said formation, said method comprising:

setting a casing anchor in said casing substantially adjacent said formation;

positioning a sidetracking whipstock onto said casing anchor;

lowering a drill string having a casing mill means on the lower end thereof whereby said casing mill means is deflected by said sidetracking whipstock into contact with said casing;

rotating said drill string to mill a window in said casing;

removing said drill string while leaving said sidetracking whipstock in place;

lowering a whipstock adaptor means onto said sidetracking whipstock, said adaptor having a lower surface which has a slope conforming to the deflecting surface of said sidetracking whipstock and an upper deflecting surface having a radius of curvature between approximately 11 feet and approximately 28 feet;

lowering a drill string having a flexible section on the lower end thereof to which an earth boring means is attached whereby said earth boring means is deflected by said deflecting surface of said deflection tool through said milled window; and rotating said drill string to drill said substantially horizontal drain hole into said formation through said milled window.

3. A method for forming a substantially horizontal drain hole in a subterranean formation from a substantially vertical case wellbore having casing extending at least adjacent said formation, said method comprising:

setting a casing anchor in said casing substantially adjacent said formation;

positioning a sidetracking whipstock having a gradual sloping deflecting surface thereon onto said casing anchor;

lowering a drill string having a starting mill on the lower end thereof whereby said starting mill is deflected by said sidetracking whipstock into contact with said casing;

rotating said drill string until said starting mill has penetrated said casing to form a hole in said casing which is substantially above the lower end of said deflecting surface on said sidetracking whipstock; and milling the casing above said hole in said casing to form an elongated window in said casing whereby a lip is formed by the casing between said window and the lower end of said deflecting surface on said sidetracking whipstock;

lowering a whipstock adaptor means onto said sidetracking whipstock, said adaptor having a lower surface which has a slope conforming to the slope of said deflecting surface on said sidetracking whipstock and having an upper deflecting surface which has a radius of curvature between approximately 11 feet and approximately 28 feet; said adaptor being held in position by contact with said lip on said casing;

lowering a drill string having a flexible section on the lower end thereof to which an earth boring means attached whereby said earth boring means is deflected by said deflecting surface of said deflection tool through said milled window; and rotating said drill string to drill said substantially horizontal drain hole into said formation through said milled window.

* * * * *